US008672781B2

(12) United States Patent
Sparks

(10) Patent No.: US 8,672,781 B2
(45) Date of Patent: Mar. 18, 2014

(54) APPARATUS AND METHOD FOR TRAINING A BASEBALL PITCHER

(76) Inventor: Eric Sparks, Cohoes, NY (US)

( * ) Notice: Subject to any disclaimer, the term of this patent is extended or adjusted under 35 U.S.C. 154(b) by 0 days.

(21) Appl. No.: 13/090,229

(22) Filed: Apr. 19, 2011

(65) Prior Publication Data

US 2012/0270686 A1 Oct. 25, 2012

(51) Int. Cl.
*A63B 69/00* (2006.01)

(52) U.S. Cl.
USPC ..... 473/451; 473/422

(58) Field of Classification Search
USPC ..... 473/422, 451, 452, 206, 207, 215, 212, 473/218; 482/123–124, 129; 434/252, 257
See application file for complete search history.

(56) References Cited

U.S. PATENT DOCUMENTS 4,846,471 A 7/1989 Haysom
6,500,078 B1 12/2002 Williams et al.
6,612,845 B1 * 9/2003 Macri et al. ..... 434/247
6,945,883 B1 9/2005 Williams et al.
7,314,437 B2 * 1/2008 Frappier ..... 482/124
7,338,395 B1 3/2008 Hurley
7,651,450 B2 * 1/2010 Wehrell ..... 482/124
2010/0130338 A1 * 5/2010 Wehrell ..... 473/215
2011/0021329 A1 * 1/2011 Dunne ..... 482/124

* cited by examiner

*Primary Examiner* — Mitra Aryanpour
(74) *Attorney, Agent, or Firm* — Eamonn Trainor

(57) ABSTRACT

The disclosure relates to a baseball pitcher training apparatus for training a pitcher in controlling his lower and upper body portions in the movement sequence of the human body associated with throwing a baseball during the pitch preparation phase as well as the delivery and follow-through phase to conserve stress or strain in the arm and leg muscles. The apparatus has a frame comprising two vertical post assemblies connected at the top by a horizontal cross beam assembly. Light bag weights are suspended from the cross beam assembly and wires tensioned by circular pulley wheels are attached to the vertical post members. The pitcher learns his body mechanics from pitching with the said wires attached to his body and following a pitching line indicated by the light bag weights and gauging his position by calibration marks on the pitching mound.

14 Claims, 7 Drawing Sheets

APPARATUS AND METHOD FOR TRAINING A BASEBALL PITCHER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND

All too often promising baseball and other sports careers can be cut short due to injury sustained from improper training methods. There is no good reason why this cannot be prevented from happening.

There are several prior art references related to baseball and in particular teaching a pitcher how to improve his pitching abilities. Representative examples of them can be found in the following patents: Williams, U.S. Pat. No. 6,945,883, Williams, U.S. Pat. No. 6,500,078. Hayson, U.S. Pat. No. 4,846,471 and Hurley U.S. Pat. No. 7,338,395. The Williams patents teach a device that will help a pitcher achieve proper foot alignment as the pitcher delivers the pitch. These patents do not attempt to teach the pitcher how to achieve an efficient, effective and non-stress producing pitching throw. Hayson teaches a method for training and warming up baseball pitchers using a baseball attached to a cord and the pitcher simulating a pitching movement. It does not teach the pitcher how to gauge his body movement within the delivery motion of throwing a baseball. Hurley teaches a device that trains the pitcher in the appropriate alignment of the legs to give them their direct line during the pitching motion to home plate. It does not teach baseball pitchers how to conserve stress or strain to those muscles used in pitching.

For the foregoing reasons, there is a need for an apparatus that can train a pitcher not only in how to pitch a baseball but also in how to do so without incurring injuries as a result of lax and improper training methods.

SUMMARY

This present apparatus is a training device to teach a baseball pitcher in the proper body mechanics of how to use muscles associated with throwing a baseball so as to conserve stress or strain to those muscles. This apparatus aims to eliminate recurrent stress and strain to athletes muscles and body mechanics during training. By using this apparatus the baseball pitcher or other athlete can learn how to recognize his body motion and obtain feedback on the forces and mechanics used in pitching a baseball. The present invention is directed to an apparatus to instruct or train a pitcher in the proper body mechanics of throwing a baseball and has been developed to assist students to maximize their throwing potential that satisfies the need to eliminate the repetitive stress syndrome problem of more conventional throwing methodologies. Proper body mechanics are essential to correct repeated delivery of a pitch, control, velocity, and to prevent injury. The apparatus comprises a collapsible frame structure having two vertical and height adjustable post assemblies connected at the top ends of each vertical post assembly by a horizontal cross beam. Three light bag weights are suspended from the crossbeam at defined intervals and can be adjusted for height. The apparatus also comprises a pitching mound which is secured to the ground. Four wires or in the alternative four flexible elastic stretchable cords are secured at one end by harnesses to each of the two wrists and two ankles of the trainee pitcher. The other end of each of the wires or flexible elastic stretchable cord is in turn secured to each of four circular pulleys two of which are attached to each vertical post assembly that can be adjusted to vary the tension in the wires or flexible elastic stretchable cords either separately or in coordination with the other wires to provide a resistance means. There are also two mirrors attached to each of the two vertical post assemblies and calibrated markings on the pitching mound to indicate position to the pitcher. The apparatus is designed to be manufactured with different materials and to have an electronic device and software means to provide precise and measurable information to the pitcher. In addition, the apparatus provides a method for a baseball pitcher to learn how to pitch a baseball without incurring injury.

DRAWINGS

These and other features, aspects, and advantages of the present invention will become better understood with regard to the following description, appended claims, and accompanying drawings where:

DESCRIPTION

This is an apparatus to teach a pitcher the proper body mechanics when throwing a baseball so as to conserve stress or strain to those muscles used in pitching/throwing the baseball. Specifically it will teach the pitcher the correct body movement to avoid incurring injuries that could jeopardize a baseball career. It will teach the pitcher to become spatially aware of the pitcher's position and movement of arms, legs and torso throughout the delivery of the pitch in order to avoid injury to the pitcher that may result from improper body mechanics. It will also teach the pitcher to be aware of the forces involved in pitching a baseball in all parts of the pitcher's body either through feeling the resistance tension in his arms and legs or through diagnostic computerized information displayed on a monitor or through a printout to give precise readings on forces incurred and speed of movement.

Figure 1:
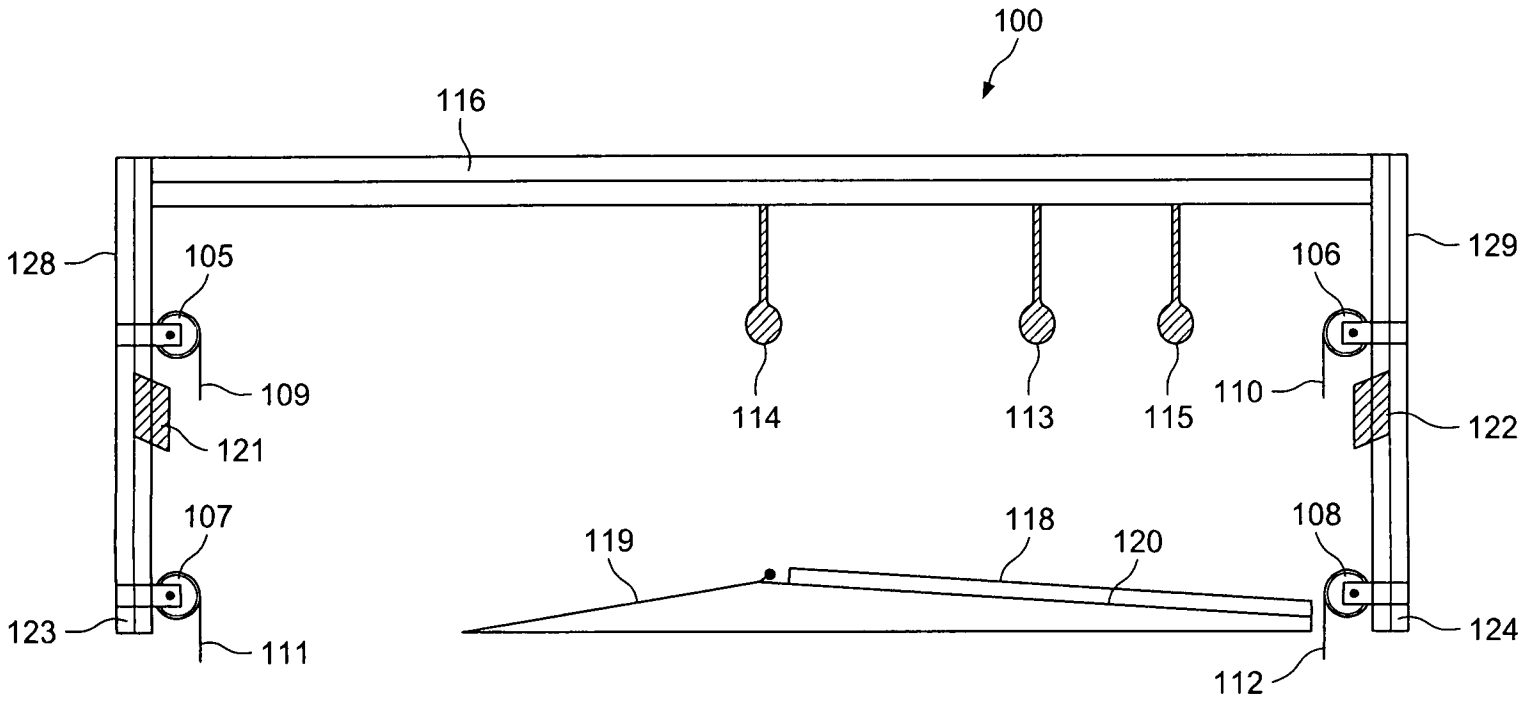
FIG. 1 shows a side view of the training apparatus, showing the primary frame structure in an assembled condition with the component training devices attached thereto.
Figure 2:
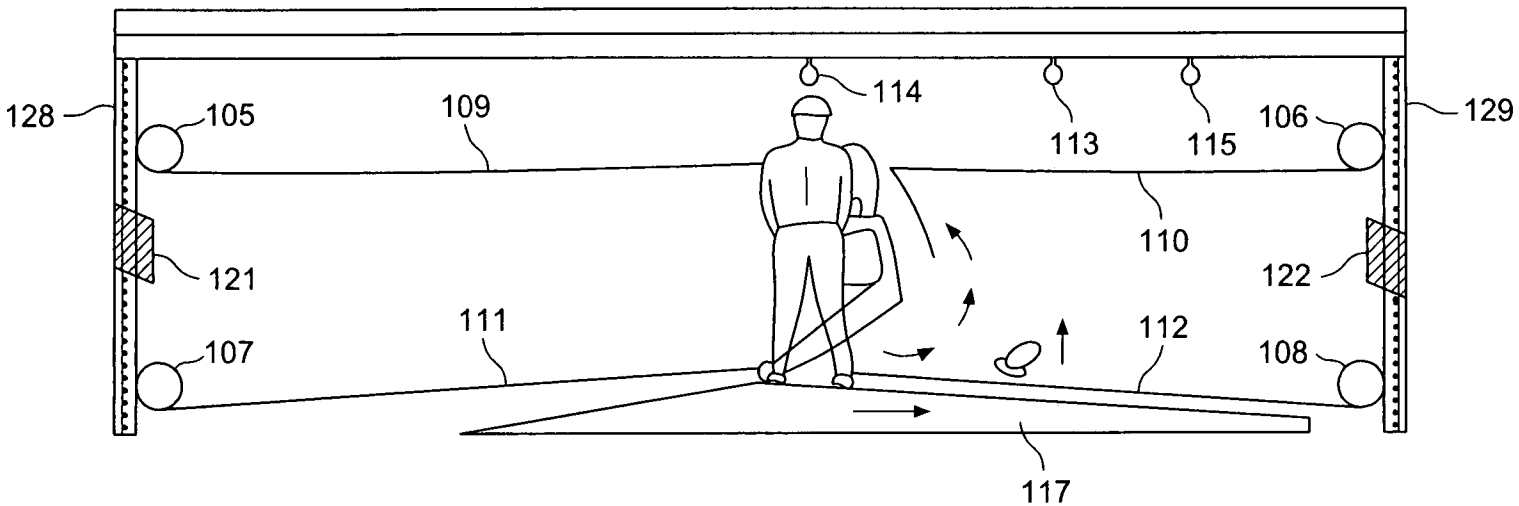
FIG. 2 shows the apparatus being used by the trainee pitcher with the wires or the flexible elastic stretchable cords attached to the circular pulleys.
Figure 3:
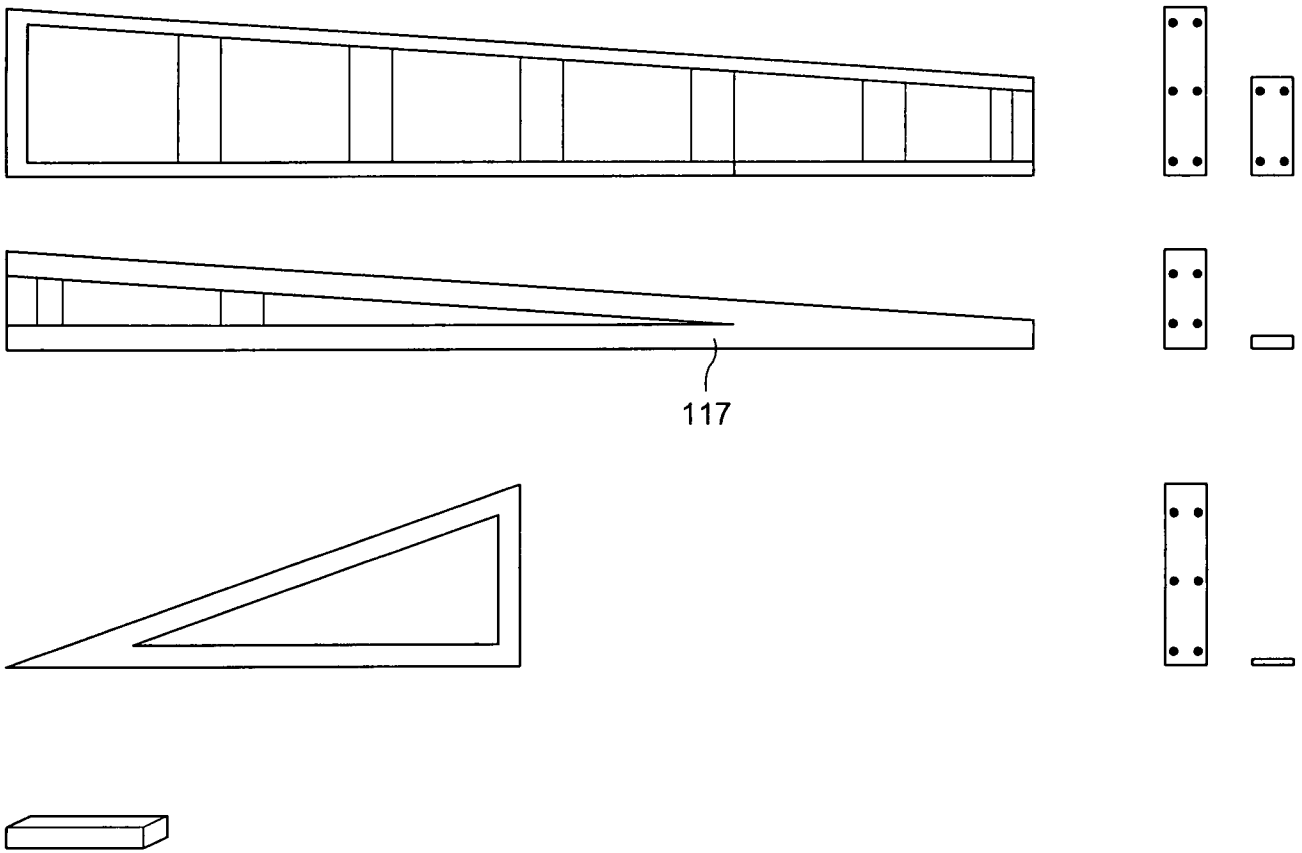
FIG. 3 shows an isolated view, shown in partial sections, illustrating the mound components.
Figure 4:
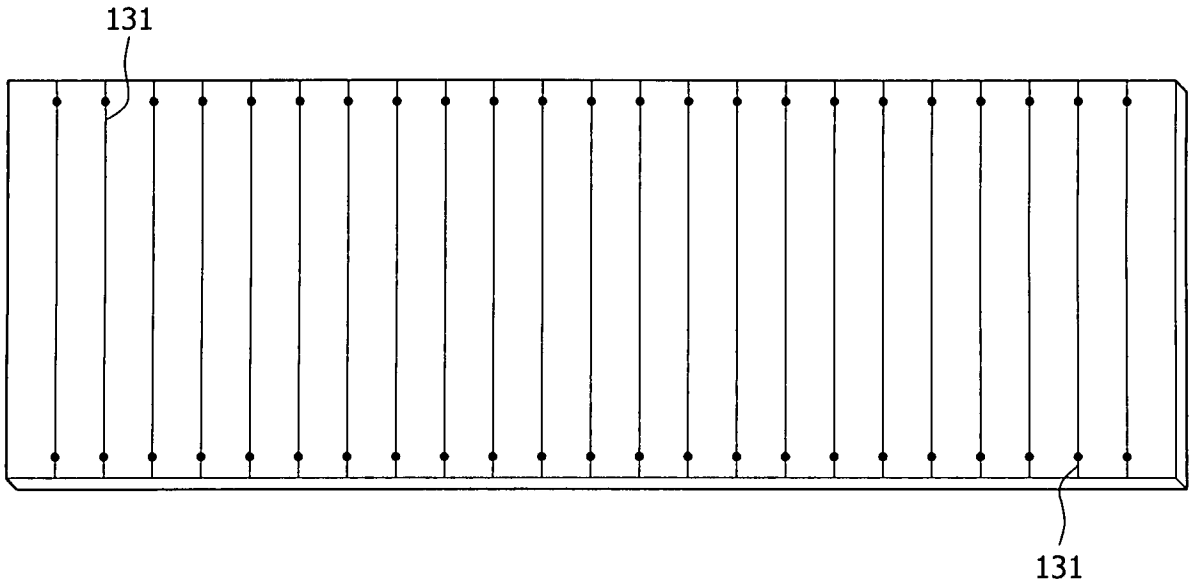
FIG. 4 shows an overhead view of the mound platform.
Figure 7:
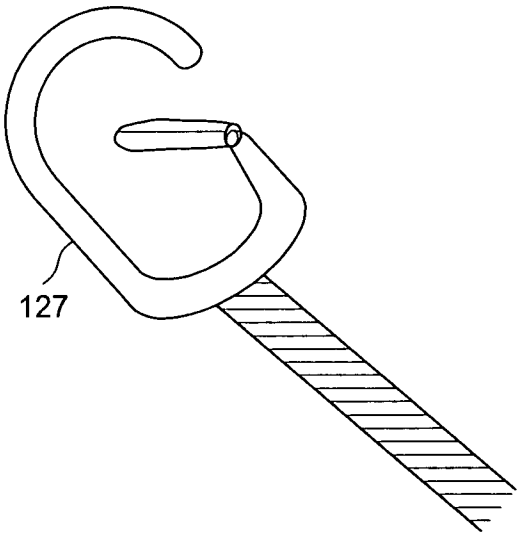
FIG. 7 shows another view of the apparatus being used by the trainee pitcher with the wires or the flexible elastic stretchable cords attached to the circular pulleys.

FIG. 1 generally shows a training apparatus to train a baseball pitcher at 100. This training apparatus 100 has a primary frame structure which includes two vertical post assemblies 128 and 129 and a horizontal cross beam assembly 116. One circular pulley each of 105 and 106 is attached by a fastening element to the upper part of each vertical post member. In addition, one circular pulley each of 107 and 108 is attached by a fastening element to the lower part of each vertical post member. Light bag weights 113, 114 and 115 are suspended from the horizontal cross beam assembly 116. Each of four wires or in the alternative four flexible elastic stretchable cords 109, 110, 111 and 112 are attached one to each pulley as shown in FIG. 2 and FIG. 7. A pitching mound 117 as shown in FIG. 3 is inserted on the ground at the base of the apparatus and between both the vertical post assemblies and underneath the cross beam member. The pitching mound has calibrated markings 131 at pre-set equidistant intervals along the longitudinal axis as shown in FIG. 4. The pitching mound is comprised of a pitching plate 118, a landing slope 119 and a backstep slope 120. A mirror 121 and 122 is attached to each upper vertical post assembly. There are two base members 123 and 124 placed on the ground and into which the vertical post assemblies are inserted.

In the present specification and claims, the word "elastic stretchable cords" is used in the broader sense to include elongated, highly flexible and elastic elements whether or not they incorporate numerous fibers or strands.

It is comprised, in part, of a pitching mound 117, such as is used in baseball, and which can be made from a variety of materials including wood. The apparatus uses a calibrated, non-biased, repetitive approach that by feel allows the user to learn toe-to-finger muscle memory. It is based on fluid movement and the elimination of thought mechanics. It gives the user a specific and adjustable wind amount that engenders both flexible and measurable energy to the ankles and wrists. With the two points of aerial contact to the wrists and corresponding points of contact to the ankles, the user can learn to increase his feel, gauge his improvement and relax his mind. This training apparatus 100 has been designed so that it may be used to strengthen and conserve usage of all the muscles associated with throwing a baseball. This training apparatus 100 is versatile because it can be used to aid baseball pitching/throwing along with performing wrist movement exercises, arm exercises, rotator cuff exercises, shoulder exercises, triceps exercises and more such as leg exercises, and torso exercises. This training apparatus 100 can be used by the little leaguer, up through the professional athlete, because the intensity of the workout can be increased by increasing the tension of the connecting wires or flexible elastic stretchable cords attached to the pitcher's wrists and ankles. As an athlete gets stronger the tension can be increased to increase output. The subject apparatus provides a training device for a baseball pitcher, which is lightweight, portable, easily erected and can be used indoors in a gymnasium or outdoors on a practice field.

Figure 6:
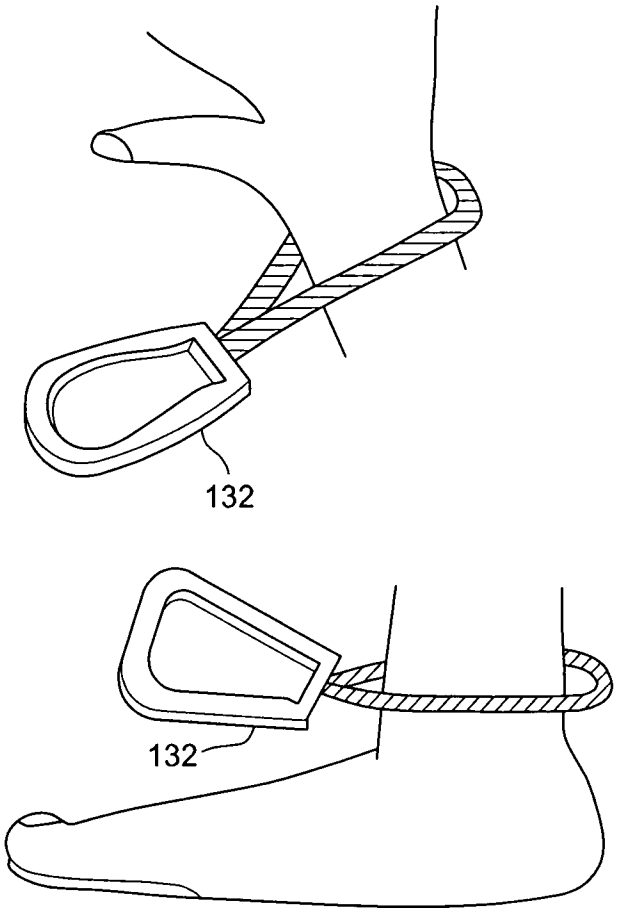
FIG. 6 shows the harness attached to each wire or in the alternative four flexible elastic stretchable cords and the clip that is attached to each of the wrists and ankles of the baseball pitcher using the apparatus.
Figure 8:
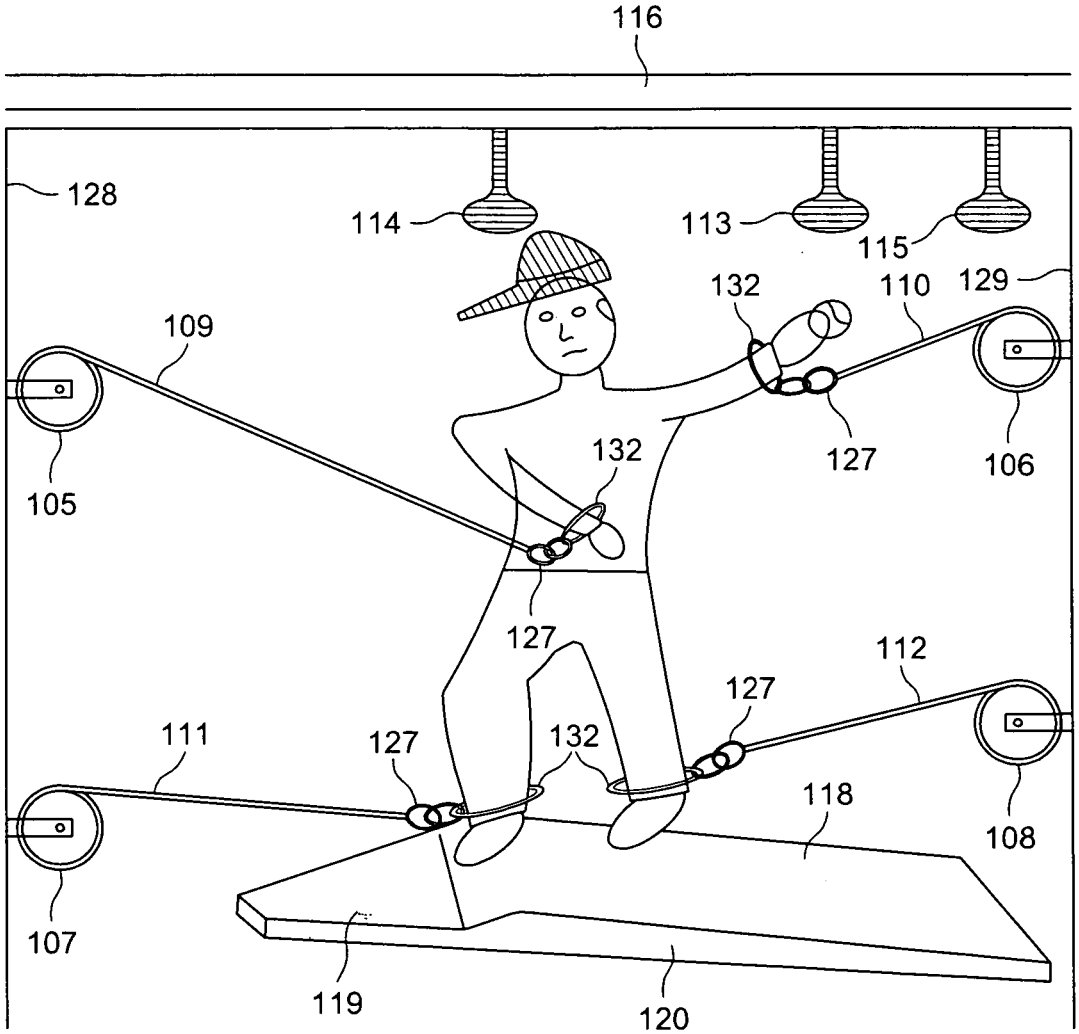

The training apparatus includes four wires encased in rubberized tubing or in the alternative four flexible elastic stretchable cords 109, 110, 111 and 112 which have a means to be attached at one end and are wrapped around each of four circular pulley wheels 105, 106, 107 and 108 as shown in FIG. 2 which can be adjusted for increasing or decreasing of tension in the said wires or cords, depending on the tension desired, and which have a harness 127 (such a those used by mountain climbers to secure ropes) at the other end that attaches either to the ankles and wrists of a person using the training apparatus and that hook onto clips 132 attached to the wrists and ankles of the said person using the training apparatus as shown in FIGS. 6 and 7. Two of each of the circular pulley wheels 105, 106, 107 and 108 are attached to each vertical post assembly 128 and 129 and are adjustable as to the distance they are spaced apart with respect to each other on each vertical post assembly. The two upper circular pulley wheels 105 and 106 on each vertical post assembly 128 and 129 can be adjusted in height by being removed and inserted into calibrated notches 130 created in the upper part of the vertical post members. The two lower circular pulley wheels 107 and 108 on each vertical post assembly 128 and 129 can also be adjusted in height by being removed and inserted into calibrated notches 130 created in the lower part of each vertical post member. This allows for height adjustment as required by the pitcher.

When a pitcher practices a throw of a baseball, the pitcher stands on the pitching mound 117 that is secured to the ground by a securing means. The purpose of the securing means is to prevent the pitching area from shifting during use.

There are three light bag weights 113, 114 and 115 suspended from the cross beam assembly 116. One light bag weight 114 is suspended above the uppermost ridge of the mound above the pitching plate 118. Another light bag weight 113 is suspended above the backstep slope 120 at the half way distance down the pitching mound directly behind where the pitcher stands. The last light bag weight 115 is suspended above the backstep slope three quarters of the distance from the uppermost ridge of the mound to the end of the mound directly behind where the pitcher stands. The light bag weights drop down from above from the horizontal cross beam member 116 and can be adjusted for height as required.

The training apparatus 100 also includes mirrors 121 and 122 attached to each vertical post assembly 128 and 129 along the longitudinal axis to enable the pitchers to maintain alignment along a central position and to gauge their mechanical body motion in pitching the baseball.

There are calibrations 131 longitudinally marked on the pitching mound to let the pitcher know where he/she is on the portable pitching mound on the backstep slope area 120, pitching plate 118 and the landing slope area 119. These calibrated markings are continued on through to the periphery of the landing area permitting the user to check his stride length.

The pitcher will have each of the four wires or in the alternative four flexible elastic stretchable cords 109, 110, 111 and 112 attached to each of the pitcher's ankles and wrists at a required tension. The pitcher starts his/her motion at the uppermost ridge of pitching mound 117. The pitcher will commence movement by having his/her throwing hand in contact with the light bag weight 113 suspended from the cross beam assembly 116 that is directly behind the direction of throwing at the half way distance down the backstep slope directly behind where the pitcher stands. The pitcher will wind his body to throw the baseball and aim to make contact with the light bag weight 114 suspended directly above the upper ridge of the mound. In other words, the pitcher will hit the light bag weight 113 behind the pitcher with his throwing hand and then hit the light bag weight 114 suspended at the front of pitcher with the same throwing hand as the target area for releasing the ball.

Figure 5:
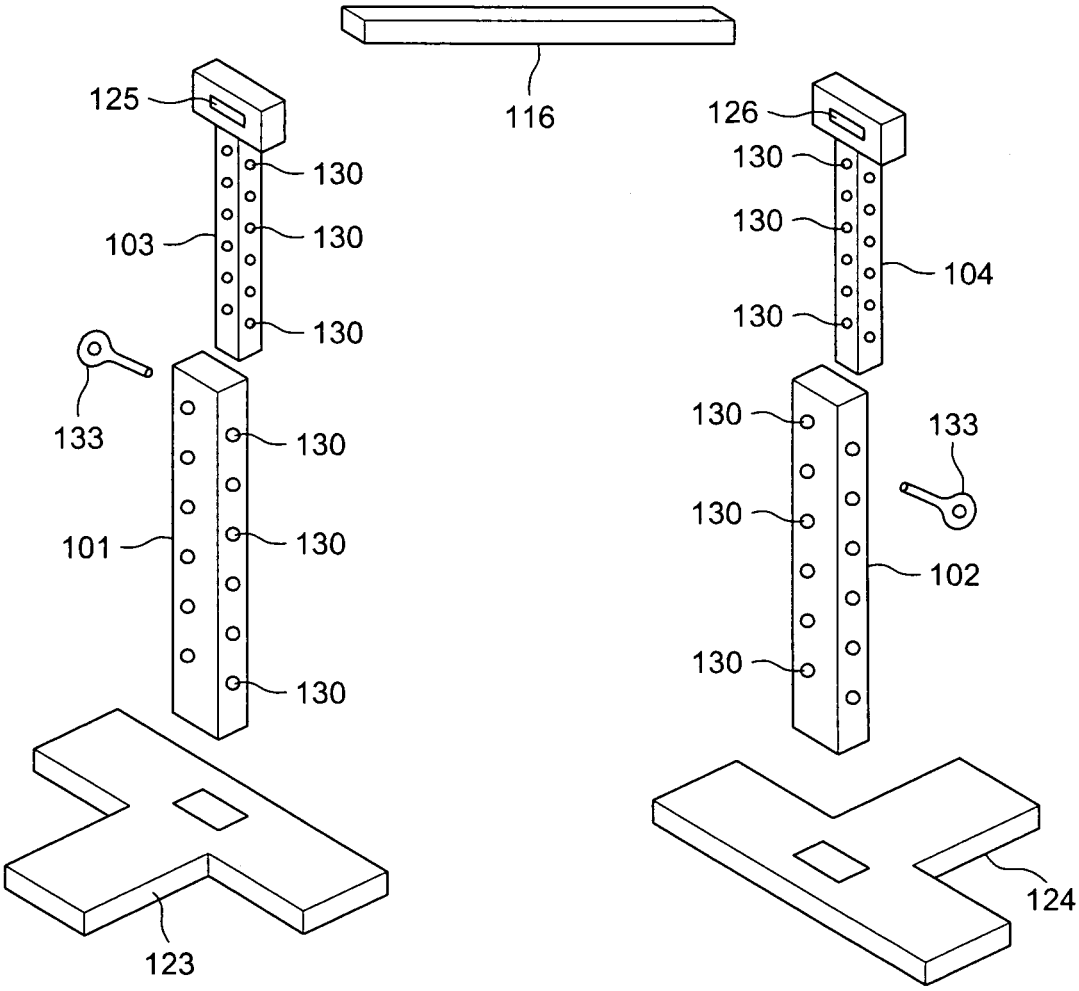
FIG. 5 shows an alternative embodiment of the apparatus which shows a portion of the construction of the apparatus that is collapsible and can be reconfigured for height and length.

The training apparatus 100 can have an additional embodiment whereby it can also be constructed to have a primary frame structure including a pair of base members 123 and 124, first and second vertical post assemblies 128 and 129 which are each comprised of one lower vertical post member 101 and 102 and one upper vertical post member 103 and 104 each lower vertical post member 101 and 102 attachable to the respective base member 123 and 124 and an upper vertical post member 103 and 104 telescopically received within the lower vertical post members 101 and 102 and selectively positionable relative thereto to adjust a height of a top end of the upper vertical post member 103 and 104 using rods 133 insertable in holes in the said posts, and a horizontal cross beam assembly including an elongate horizontal cross beam assembly 116 as shown in FIG. 5. The top ends of the upper vertical post members are provided with receptacles 125 and 126 for receipt of outboard ends of the horizontal cross beam assembly so that the horizontal cross beam assembly spans between the spaced apart vertical post assemblies at a selected, adjusted height above the floor. The base members 123 and 124 are specifically structured to rest on a flat surface with the extending feet sections providing stability. The frame structure of the training apparatus 100 is fully collapsible and can be reconfigured for height and length. FIG. 5 does not shown all the components of the apparatus.

This structure is just one example of elements operable in the training apparatus.

Another embodiment of the training apparatus will include an electronic measuring device operated by generic software which said electronic measuring device will measure the tension applied to the four wires or in the alternative four flexible elastic stretchable cords 109, 110, 111 and 112 in order to provide the pitcher via an electronic display with information as to the forces tensioned in the said four wires or elastic cords, forces imparted to the wires or cords through the pitch delivery motion of the pitcher and speed of delivery of a pitch.

In accord with another aspect of the training apparatus 100, a method of training a baseball pitcher is also provided, attaching four wires or in the alternative four flexible elastic stretchable cords 109, 110, 111 and 112 individually to each of the ankles and wrists of the pitcher and each wire attached at the other end to each of four circular pulley wheels 105, 106, 107 and 108. The pitcher stands on the inclined pitching mound 117 and makes contact with the light bag weight 113 behind the direction of throwing with his throwing hand. The pitcher then executes a winding throwing motion to pitch a baseball. The pitcher makes contact with his throwing hand with the light bag weight 114 above the highest ridge of the mound 117 and releases the baseball at that point of contact. The pitcher obtains information by electronic means or by spatial awareness of his body movement of the manner of his execution of the baseball pitch and learns how to conserve his body from stress and strain incurred through the mechanics of pitching a baseball.

The previously described versions of the present apparatus have many advantages, including teaching the pitcher's mind how to control his body. It corrects for the flawed mechanics inherent in the teaching methods used for baseball pitchers. It is an apparatus that allows the user to easily adopt the most efficient, effective and non-stress producing pitching throw based on extensive research of body mechanics and the kinetics of the throwing motion.

In addition, this invention relates to the field of exercise and training equipment and more particularly to a collapsible, portable, lightweight training device, which can be used with equal effectiveness by either left or right-handed pitchers and can be used indoors in a gymnasium or outdoors on a practice field.

It is not necessary for all embodiments of the invention to have all the advantages of the invention or fulfill all the purposes of the apparatus.

While the instant apparatus has been shown and described in accordance with preferred and practical embodiments thereof, it is recognized that departures may be made from the instant disclosure. Therefore, the spirit and scope of the appended claims should not be limited to the description of the preferred versions contained herein.

In the Summary above and in the Description, and the Claims below, and in the accompanying drawings, reference is made to particular features (including method steps) of the apparatus. It is to be understood that the disclosure of the apparatus in this specification includes all possible combinations of such particular features. For example, where a particular feature is disclosed in the context of a particular aspect or embodiment of the apparatus, or a particular claim, that feature can also be used, to the extent possible, in combination with and/or in the context of other particular aspects and embodiments of the apparatus, and in the apparatus generally.

The term "comprises" and grammatical equivalents thereof are used herein to mean that other components, ingredients, steps, etc. are optionally present. For example, an article "comprising" (or "which comprises") components A, B, and C can consist of (i.e. contain only) components A, B, and C, or can contain not only components A, B, and C but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

What is claimed is:

1. A training apparatus to train a baseball pitcher comprising:

a primary frame structure operable between a collapsed condition and a plurality of assembled conditions defined by a plurality of different structural configurations, and said primary frame structure including:

a pair of vertical post;

a horizontal cross member structured for fitted, sliding receipt within said pair of vertical post, said horizontal cross member being disposed along a common longitudinal axis to define a fully assembled length of said horizontal cross member;

a pitching mound, wherein the pitching mound is planar and inclined and wherein the pitching mound is of a predetermined thickness and includes a pitching plate, a landing slope and a backstep slope;

a plurality of pulleys each of which are attached to each of said pair of vertical posts by a fastening element inserted onto each of said pair of vertical posts;

a plurality of wires, wherein one end of each wire is connected to one of the plurality of pulleys, wherein two of the other ends of each of the said wires is connected one to each ankle of a baseball pitcher and the other two ends of each of the said wires are connected one to each wrist of the baseball pitcher by a harness or a strap attached to the said wires and hooked onto clips or straps attached to the wrists and ankles of the baseball pitcher using the training apparatus;

a plurality of accessory components, and adjustment procedures for selectively adjusting an attached position of individual ones of said plurality of accessory components on said primary frame structure.

2. A baseball pitcher's training apparatus to train a baseball pitcher as defined in claim 1 wherein each of said pair of vertical posts is comprised of first and second base members, each of said first and second base members having a generally T-shaped configuration defined by a plurality of feet sections, and a post socket extending upwardly from the top side of the base member at a juncture of said plurality of sections extensions;

each of said pair of vertical posts including a lower post member and an upper post member, said lower post member being structured and disposed to accommodate sliding, telescoping receipt of the said upper post member therein;

said lower post members each including a bottom end zone structured and disposed for fitted receipt within said post socket of a respective one of said first and second base members;

said upper post members each including a top end zone having a hollow receptacle formed therethrough;

interlocking of said upper post members to said respective lower post members at a plurality of telescopically adjusted positions in order to selectively adjust the height of said top end zone of said upper post members relative to said first and second base members;

locking of said bottom end zone of said lower post members within said post sockets of said respective base members so that said pair of vertical posts extend vertically upward from said first and second base members; and a horizontal cross member structured for fitted, sliding receipt within said hollow receptacles of said upper post members, said horizontal cross member including first and second elongate cross member extensions and a central coupling for releasable attachment of said cross member extensions in end to end arrangement so that said cross member extensions are disposed along a common longitudinal axis to define a fully assembled length of said horizontal cross member.

3. A baseball pitcher's training apparatus to train a baseball pitcher as defined in claim 1 wherein said plurality of accessory components includes light-weight bags suspended by cords/wires from the horizontal cross member and which are longitudinally aligned in the direction of the horizontal cross member and which can be adjusted for the height at which they are suspended above ground and which are structured and disposed for removable mounting to said horizontal cross member.

4. A baseball pitcher's training apparatus to train a baseball pitcher as defined in claim 1 further comprising said wires for exerting pressure or a force in a direction opposite to the direction of intended body movement, having a first end securable to a pulley and a second end securable by a harness or strap.

5. A baseball pitcher's training apparatus to train a baseball pitcher as defined in claim 1 wherein each said wire is comprised of an elastic band.

6. A baseball pitcher's training apparatus to train a baseball pitcher as defined in claim 1 wherein each of the plurality of pulleys is attached by removable bolts or fastening elements inserted into notches to each of the two vertical post members.

7. A baseball pitcher's training apparatus to train a baseball pitcher as defined in claim 1 wherein each of the plurality of pulleys attached to each of said pair of vertical post member are adjustable for height.

8. A baseball pitcher's training apparatus to train a baseball pitcher as defined in claim 1 further comprising calibrated markings on the said pitching mound for indicating position of the said baseball pitcher.

9. A baseball pitcher's training apparatus to train a baseball pitcher as defined in claim 1 further comprising a plurality of mirrors each of which is attached to each of the pair of vertical posts and which each face inwards towards the baseball pitcher.

10. A baseball pitcher's training apparatus to train a baseball pitcher as defined in claim 1 wherein said primary frame structure is rigid and is comprised of metal.

11. A baseball pitcher's training apparatus to train a baseball pitcher as defined in claim 1 wherein said primary frame structure is rigid and is comprised of plastic.

12. A baseball pitcher's training apparatus to train a baseball pitcher as defined in claim 1 wherein said primary frame structure is rigid and is comprised of wood.

13. A baseball pitcher's training apparatus to train a baseball pitcher as defined in claim 1 further comprising an electronic measuring device used to record calibrated resistance in the plurality of wires or plurality of elastic bands and to record speed of movement of the baseball pitcher and to provide a display said recorded information to the baseball pitcher.

14. A method of training a baseball pitcher, comprising:

a primary frame structure operable between a collapsed condition and a plurality of assembled conditions defined by a plurality of different structural configurations, and said primary frame structure including:

a pair of vertical posts;

a horizontal cross member structured for fitted, sliding receipt within said pair of vertical posts, said horizontal cross member being disposed along a common longitudinal axis to define a fully assembled length of said horizontal cross member;

a pitching mound, wherein the pitching mound is planar and inclined and wherein the pitching mound is of a predetermined thickness and includes a pitching plate, a landing slope and a backstep slope;

a plurality of pulleys each of which are attached by a fastening element inserted into each of said pair of vertical posts;

a plurality of wires or plurality of elastic bands, wherein one end of each wire or elastic band is connected to one of the plurality of pulleys, wherein two of the other ends of each of the said wires or elastic bands is connected one to each ankle of a baseball pitcher and the other two ends of each of the said wires or elastic bands is connected one to each wrist of the baseball pitcher by a harness or strap attached to the said wires and hooked onto clips or straps attached to the wrists and ankles of the baseball pitcher using the training apparatus;

a plurality of accessory components, and adjustment procedure for selectively adjusting an attached position of individual ones of said plurality of accessory components on said primary frame structure; and the method comprising:

attaching one end of each of the plurality of wires or plurality of elastic bands one to each ankle and each wrist of a baseball pitcher by a harness or strap that is attached to the said wires or elastic bands and hooked onto clips or straps attached to each wrist and each ankle of the baseball pitcher using the training apparatus and attaching the other end to each of the plurality of wires or plurality of elastic bands one to each of said plurality of pulleys;

suspending a light-weight bag from the horizontal cross member at a point directly above a highest ridge of the pitching mound positioning the baseball pitcher on the pitching mound, the baseball pitcher making physical contact with his pitching hand with the light-weight bag positioned behind the baseball pitcher's throwing direction;

causing the baseball pitcher to execute a throwing motion to pitch a baseball;

causing the baseball pitcher to firstly physically contact both the light-weight bag suspended from the horizontal cross member at a point directly above the highest ridge of the pitching mound and to secondly also physically contact another light-weight bag that is suspended from the cross member directly in front of the baseball pitcher with the baseball pitcher's throwing hand and releasing the baseball at the time of contact of the baseball pitcher's throwing hand with the light-weight bag suspended directly in front of the baseball pitcher; and obtaining information, by an electronic measuring device or by the spatial awareness of the baseball pitcher as to his body movement and of the manner of his execution of the baseball pitch so as to enable the baseball pitcher to correct or modify his body mechanics to prevent stress or strain to his muscles, tendons and skeleton.

* * * * *